US007048675B1

(12) United States Patent
Liang

(10) Patent No.: US 7,048,675 B1
(45) **Date of Patent: *May 23, 2006**

(54) FITNESS EQUIPMENT WITH THREE-DIMENSIONAL SWAY STRUCTURE

(76) Inventor: Hung-Min Liang, No. 5, Shui To Lane, Chia Hou Rd., Wai Pu Hsiang, Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/857,730

(22) Filed: Jun. 1, 2004

(51) Int. Cl.
*A63B 22/04* (2006.01)

(52) U.S. Cl. ..... 482/53

(58) Field of Classification Search ..... 482/52–53
See application file for complete search history.

(56) References Cited

U.S. PATENT DOCUMENTS 5,807,210 A * 9/1998 Devlin ..... 482/52
6,224,515 B1 * 5/2001 Chen ..... 482/53
6,709,366 B1 * 3/2004 Chuang ..... 482/53
6,709,367 B1 * 3/2004 Liang ..... 482/53
6,712,739 B1 * 3/2004 Chen ..... 482/53
6,830,539 B1 * 12/2004 Chuang ..... 482/53
6,918,857 B1 * 7/2005 Chen ..... 482/53

* cited by examiner

*Primary Examiner*—Stephen R. Crow
(74) *Attorney, Agent, or Firm*—Egbert Law Offices

(57) ABSTRACT

A modified fitness equipment of three-dimensional sway structure. The basement is provided with a pedal while a crosswise movable pipe is mounted at the bottom of the pedal. And, a dragging member is installed to provide a preset resistance to pedal during treading movement. Also, one end of the movable pipe is connected to the exterior of a shaft lever at one side of a vertical pivotal pipe over the basement. Thus, a movable end with horizontal spin can take shape at the other end of the movable pipe while a vertical swinging arm shall be installed convexly at the bottom of the movable end. Besides, the bottom of the swinging arm shall be connected to the exterior of a coupled bar via a first pin joint. The movable end of the movable pipe can horizontally sway during the treading movement, thereby generating more flexible three-dimensional sway during application.

3 Claims, 7 Drawing Sheets

FITNESS EQUIPMENT WITH THREE-DIMENSIONAL SWAY STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to fitness equipment, and more particularly to fitness equipment which generates vertical sway and horizontal spin with treading movement.

BACKGROUND OF THE INVENTION

The common fitness equipment is designed in such a manner that the treading movement of the people can be simulated to serve the purpose of fitness. With similar lateral configurations of pedal supports at the same side or both sides, the typical treading fitness equipments can generate only vertical sway. However, if the structural configuration and movement mode are maintained to develop new products, the developers will find it difficult to make some breakthrough design for imaginative and innovative products.

Therefore, this industry shall assume the responsibility of making some pioneering R&D for an innovative structure of fitness equipment.

BRIEF SUMMARY OF THE INVENTION

The present invention has offered an improved efficiency as detailed below:

1. To provide an innovative structure of fitness equipment that generates vertical sway and horizontal spin with treading movement.

2. Based upon the unique structure of three-dimensional sway, the fitness equipment can provide a flexible and interesting physical exercise.

The new features of the present invention are as follows:

Based upon the structural design that the coupled bar 30 is provided coaxially at the lower spacing position of the movable pipe 11, it is possible to minimize the space of the coupled bar 30 and guarantee the smooth appearance of the fitness equipment as well as personal safety.

DETAILED DESCRIPTION OF THE INVENTION

Figure 1:
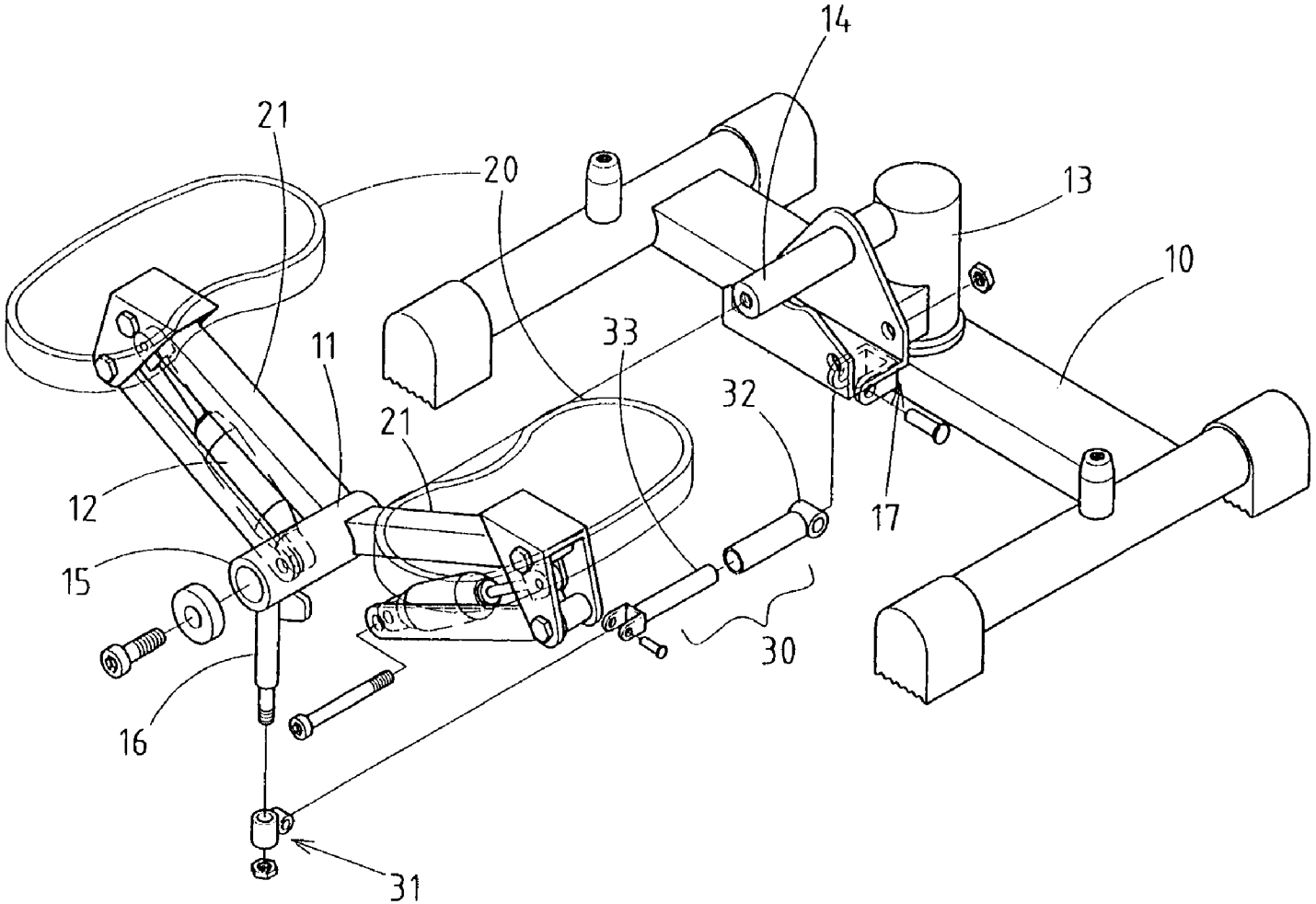
FIG. 1 shows an exploded perspective view of the preferred embodiment of the present invention.
Figure 2:
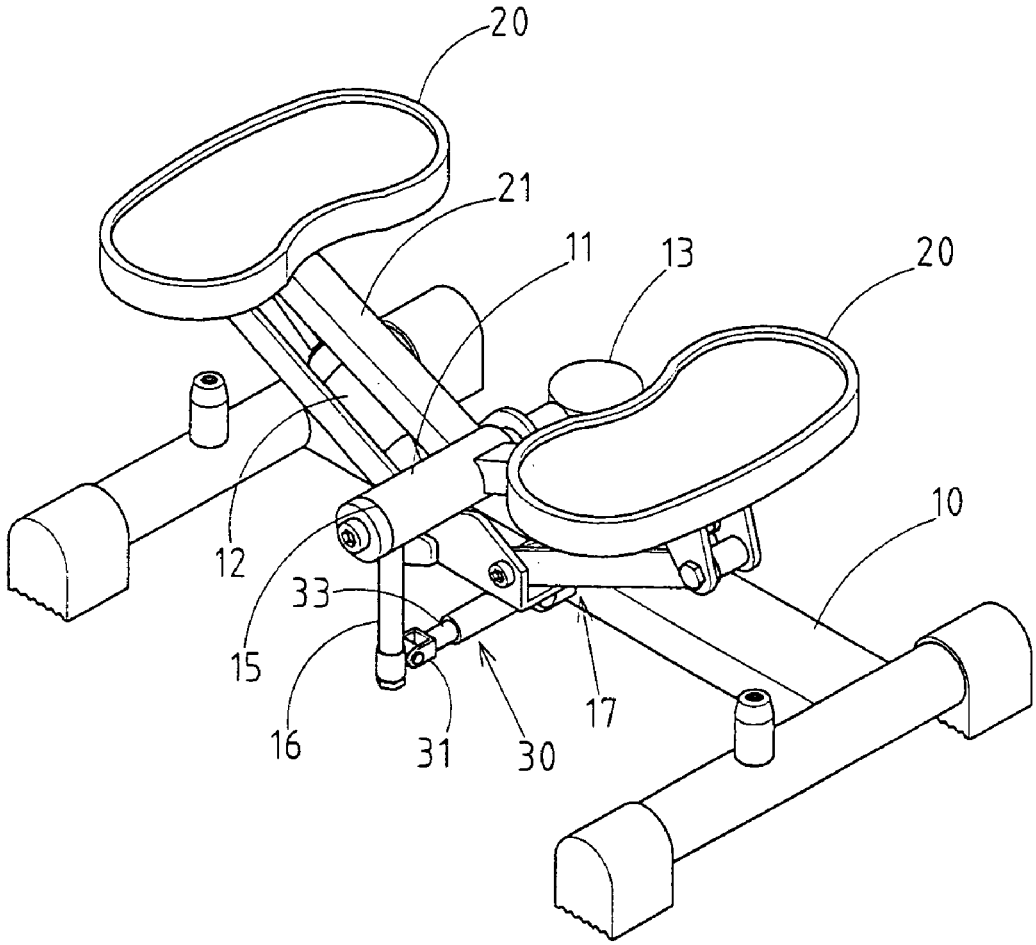
FIG. 2 shows a perspective view of the present invention
Figure 3:
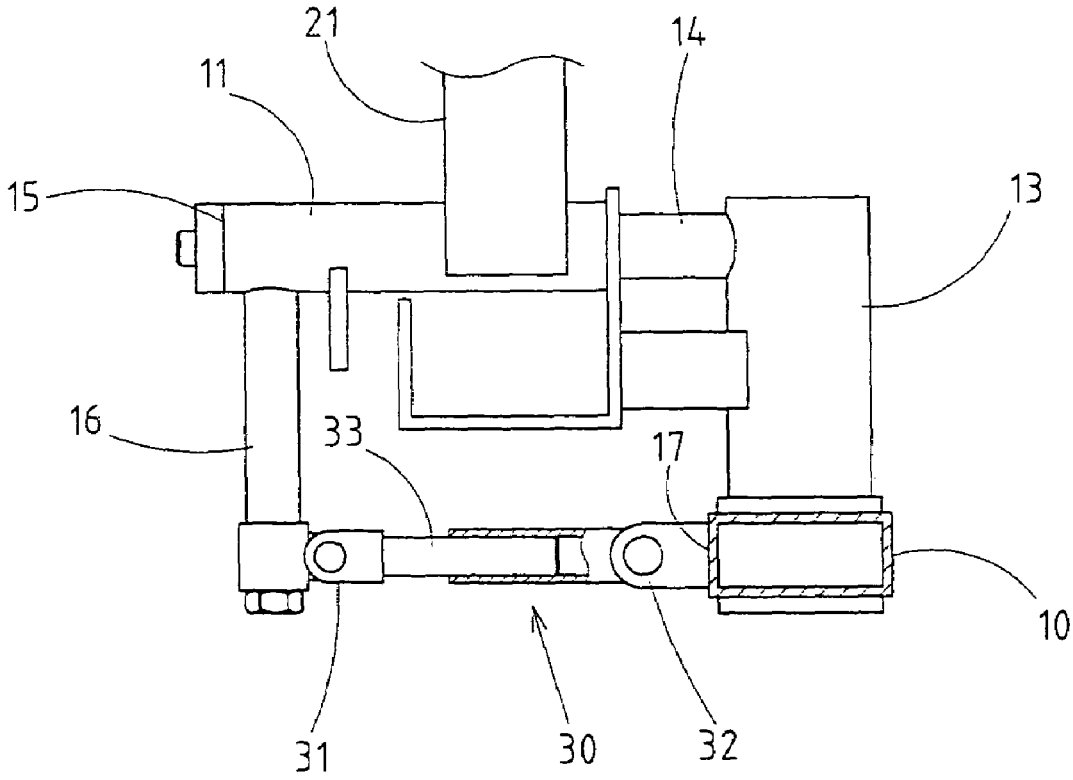
FIG. 3 shows a partial sectional view of the present invention.
Figure 4:
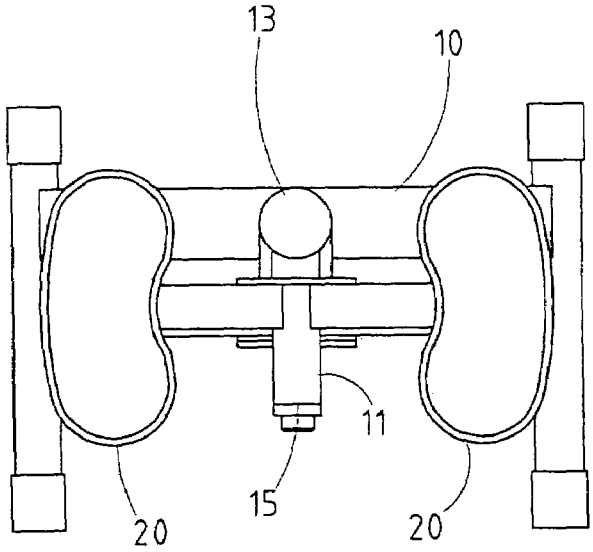
FIG. 4 shows a top plan view of the suspending state of the present invention.
Figure 5:
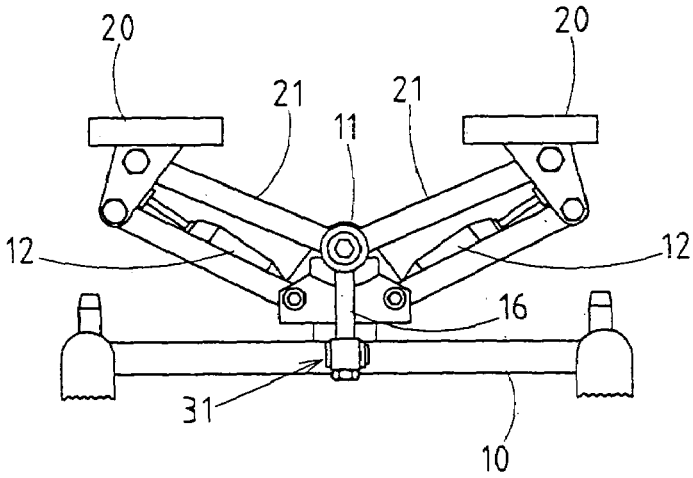
FIG. 5 shows a front elevation view of the present invention.
Figure 6:
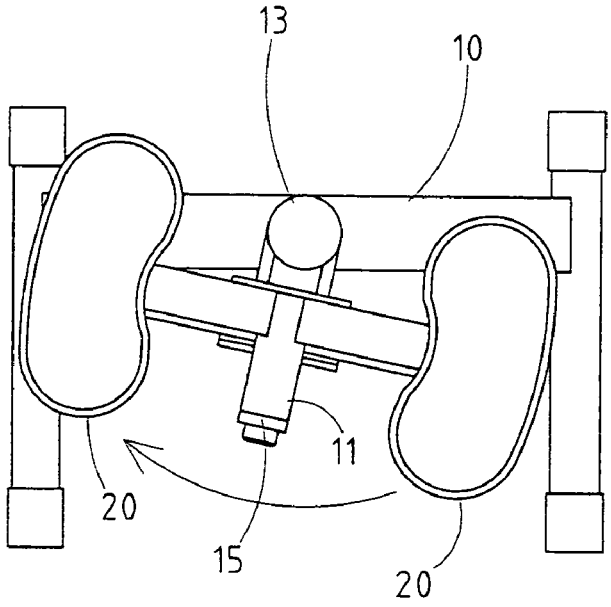
FIG. 6 shows a top plan view of implementation.
Figure 7:
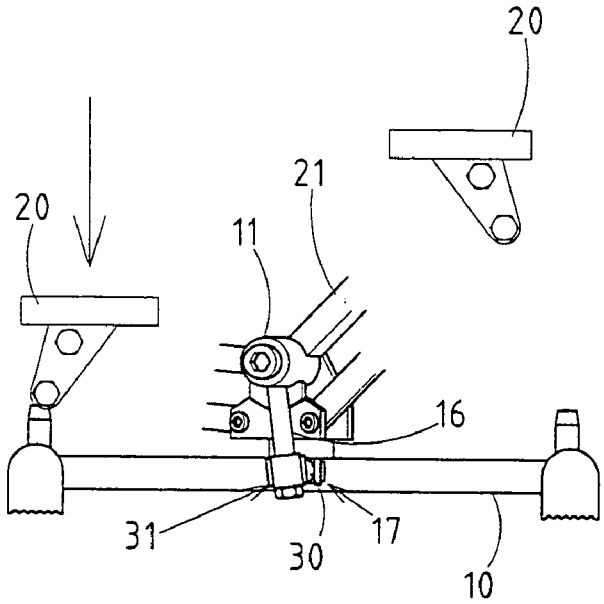
FIG. 7 shows a front elevation view of FIG. 6.
Figure 8:
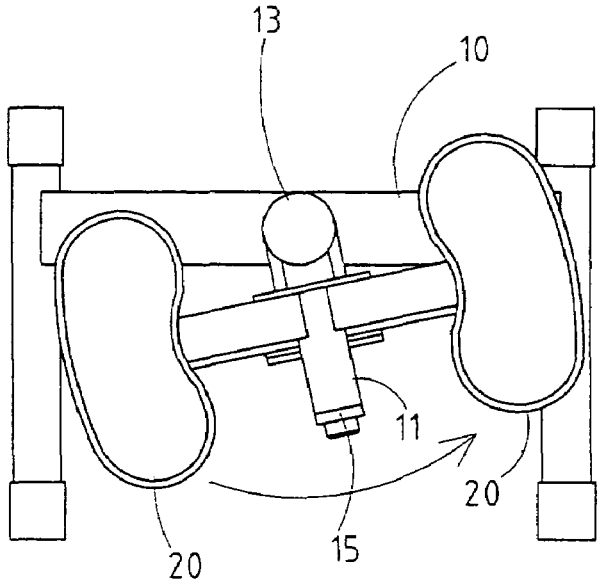
FIG. 8 shows another top plan view of implementation.
Figure 9:
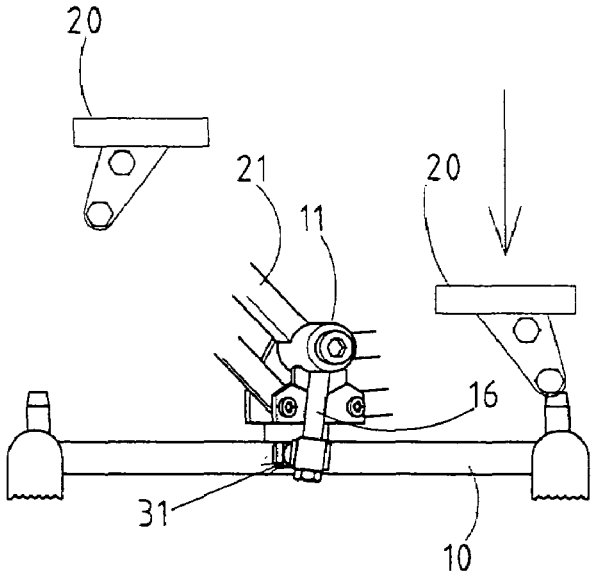
FIG. 9 shows a front elevation view of FIG. 8.

The features and the advantages of the present invention will be more readily understood upon a thoughtful deliberation of the following detailed description of a preferred embodiment of the present invention with reference to the accompanying drawings.

As shown in FIGS. 1–5, fitness equipment embodied in the present invention comprises: a basement 10, which is provided with a pedal 20. A crosswise movable pipe 11 is mounted at the bottom of the pedal 20 to enable both sides to sway vertically with the movable pipe 11 as the pivot point. And, a dragging member 12 (e.g. nitrogen bar) shall be installed to provide a preset resistance to pedal during treading movement. Also, one end of the movable pipe 11 is connected to the exterior of a shaft lever 14 at one side of a vertical pivotal pipe 13 over the basement 10. Thus, a movable end 15 with horizontal spin can take shape at the other end of the movable pipe 111 while a vertical swinging arm 16 shall be installed convexly at the bottom of the movable end. Besides, the bottom of the swinging arm shall be connected to the exterior of a coupled bar 30 via a first pin joint 31.

The coupled bar 30 is provided coaxially at the lower spacing position of the movable pipe 11. The interior of the coupled bar 30 shall be connected to a fixation point 17 at the corresponding side wall of the basement 10 via a second pin joint 32. But, the second pin joint 32 allows only the coupled bar 30 to sway vertically. And, the middle part of the coupled bar 30 shall be designed with an expansion section 33.

Of which, the pedal of the basement 10 is available with a structure of left and right pedals 20. Moreover, both sides of the bottom of left and right pedals can be attached securely to both sides of the movable pipe 11 via a support bar 21.

Based upon above-mentioned constructions and components, the vertical swinging arm 16 will generate simultaneously pointer type sway when left and right pedals 20 swing owing to alternative treading movement (refer to FIGS. 6–9). As the other end of the coupled bar 30 is immobile due to the limitation of the fixation point 17 of the basement 10, the counteracting force will enable the movable end 15 of the movable pipe 11 to sway horizontally with the pivotal pipe 13 as the pivot point. Thus, the fitness equipment will generate vertical sway and horizontal spin with treading movement. And, with regard to the design of the middle part of coupled bar 30 as an expansion section 33, the distance between the bottom of the vertical swinging arm 16 and the fixation point 17 of the basement 10 will vary a little during its pointer type swing. So, the expansion section 33 can ensure a smooth operation accordingly.

Figure 10:
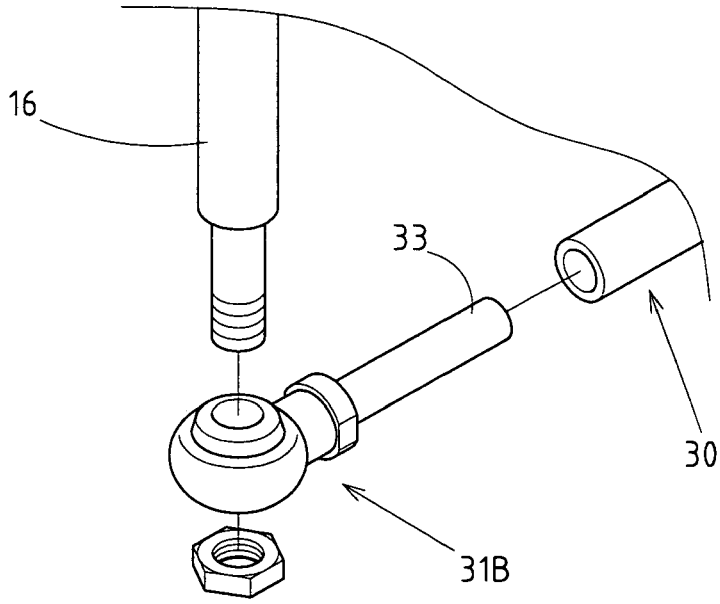
FIG. 10 shows a partial exploded perspective view of the connection of first pin joint.

As shown in FIG. 10, the first pin joint at the bottom of the swinging arm 16 is available with another structure. With a ball-type universal joint, the first pin joint 31B can be applied for connection of the same function.

Figure 11:
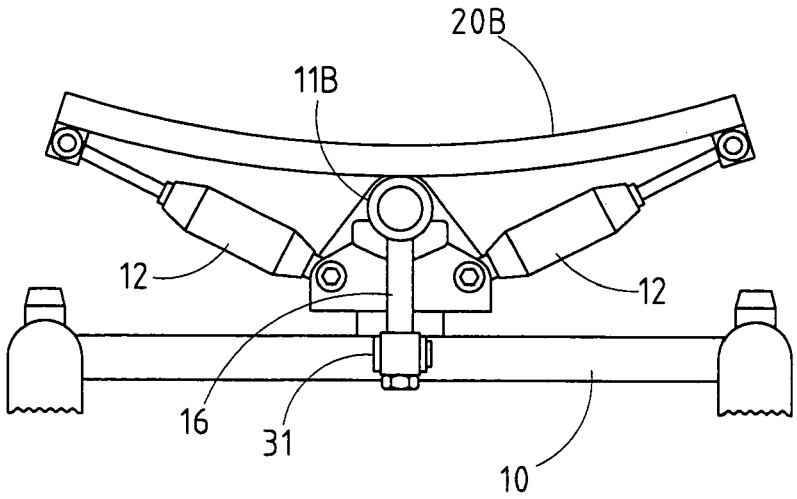
FIG. 11 shows another front elevation view of the implementation of the stepper.

As shown in FIG. 11, the pedal 20B of the basement 10 is also available with a single-plate structure, which can enable horizontal movable pipe 11B to be directly fixed (e.g. welding and locking, etc) into the bottom center of the pedal 20B.

I claim:

1. A fitness apparatus having a vertical sway structure comprising:

a base having a vertical pivot pipe extending upwardly therefrom, said vertical pivot pipe having a shaft lever extending outwardly from a side thereof;

a first pedal having a pipe connected to a bottom of thereof, said pipe being sleeved onto an exterior of said shaft lever;

a second pedal in spaced relation to said first pedal, said second pedal being connected to said pipe, said first and second pedals movable vertically as said pipe rotates with respect to said shaft lever, said vertical pivot pipe rotatable with respect to said base such that said first and second pedals can spin in a horizontal plane;

a first resistance member connected to said first pedal and interconnected to said base so as to provide a resistance to the vertical movement of said first pedal;

a second resistance member connected to said second pedal and interconnected to said base so as to provide a resistance to the vertical movement of said second pedal;

a vertical arm extending vertically downwardly from said pipe; and a coupled bar connected to a lower end of said vertical arm by a first pin joint, said coupled bar having an interior that is connected to a fixation point at a side of said base by a second pin joint, said coupled bar swayable vertically about said second pin joint with respect to said base, said coupled bar having an expansion section in a central area thereof.

2. The apparatus of claim 1, said first pedal being a left pedal, said second pedal being a right pedal, said first and second pedals being attached respectively by first and second support bars extending from opposite sides of said pipe.

3. The apparatus of claim 1, said pipe being directly mounted to an underside of one of said first and second pedals.

* * * * *